US007467971B2

(12) United States Patent
Lin et al.

(10) Patent No.: US 7,467,971 B2
(45) Date of Patent: Dec. 23, 2008

(54) RETRACTABLE EXTENSION SOCKET

(75) Inventors: Yi-Ching Lin, Chung Ho (TW); Ming-Chou Kuo, Chung Ho (TW)

(73) Assignee: Powertech Industrial Co., Ltd., Taipei Hsien (TW)

( * ) Notice: Subject to any disclaimer, the term of this patent is extended or adjusted under 35 U.S.C. 154(b) by 0 days.

(21) Appl. No.: 11/637,872

(22) Filed: Dec. 13, 2006

(65) Prior Publication Data

US 2008/0090434 A1 Apr. 17, 2008

(30) Foreign Application Priority Data

Oct. 12, 2006 (TW) ..... 95218013 U

(51) Int. Cl.
*H01R 13/72* (2006.01)

(52) U.S. Cl. ..... 439/501; 191/12.2 R

(58) Field of Classification Search ..... 439/501, 439/528; 191/12.2 R, 12.4
See application file for complete search history.

(56) References Cited

U.S. PATENT DOCUMENTS 2,536,776 A * 1/1951 Smellie ..... 99/385
4,520,239 A * 5/1985 Schwartz ..... 191/12.4
4,656,320 A * 4/1987 Maddock ..... 191/12.4
5,071,367 A * 12/1991 Luu ..... 439/501
5,507,667 A * 4/1996 Hahn et al. ..... 439/501
6,503,097 B2 * 1/2003 Archambault ..... 439/501
6,574,120 B1 * 6/2003 Chou ..... 361/819
6,705,890 B2 * 3/2004 Kitou et al. ..... 439/528
6,705,891 B1 * 3/2004 Lin ..... 439/528
6,722,917 B2 * 4/2004 Huang ..... 439/501
6,848,937 B1 * 2/2005 Hsiao ..... 439/528
7,081,006 B2 * 7/2006 Lichtscheidl et al. ..... 439/501

* cited by examiner

*Primary Examiner*—Thanh-Tam T Le
(74) *Attorney, Agent, or Firm*—Rosenberg, Klein & Lee

(57) ABSTRACT

A retractable extension socket includes an socket body, a fixing structure, a receiving structure, a conducting wire and a plug. The fixing structure and the receiving structure are disposed on the socket body. One end of the conducting wire is connected to the socket body. The plug is connected to the other end of the conducting wire. Thus, a retractable extension socket is formed. The retractable extension socket can be used as an extension socket. In addition, by winding the cable into the socket body and attaching the plug into the fixing structure, the retractable extension socket can be used as a single plug. Furthermore, the plug can be collected into the receiving structure in order that it can be carried around easily.

13 Claims, 8 Drawing Sheets

RETRACTABLE EXTENSION SOCKET

BACKGROUND OF THE INVENTION

1. Field of the Invention

The present invention relates to a retractable extension socket, and particularly relates to an outlet structure with a retractable extension socket.

2. Description of the Related Art

An outlet is mainly used for transmitting power to various electronic devices. Due to the gradual increase in the number of electronic devices in both homes and businesses, the usage of outlets has become greater. Dealers, also, are constantly improving the quality of outlets.

Extension sockets commonly include a socket body. There can be several sockets disposed on top of the socket body. The interior of the socket body includes electric conducting plate sheets corresponding to the sockets. The electronic conducting plate sheet is connected to a conducting wire. The other end of the conducting wire penetrates through the socket body and is connected with a plug electrically. When the plug is plugged into a household socket, power can be transmitted from the plug to the conducting wire and to the socket body accordingly. Thereby supplying power to electronic devices plugged in the socket body.

The aforementioned household outlet can only be used in a single mode and cannot be used in other modes. Furthermore, the socket body, conducting wire and plug are not properly fixed. Thus, they create a more cluttered appearance.

SUMMARY OF THE INVENTION

One particular object of the present invention is to provide a retractable extension socket to increase the usage modes of the outlet.

Another particular object of the present invention is to provide a retractable extension socket. Therefore, the socket body, conducting wire and the plug are properly fixed and do not have a cluttered appearance.

In order to achieve the above-mentioned objects, the present invention provides a retractable extension socket, comprising an socket body, a fixing structure disposed on the socket body, a receiving structure disposed on the socket body, a conducting wire connected to the socket body on one end thereof, and a plug connected to the other end of the conducting wire.

Another particular aspect of the present invention is to provide a retractable extension socket, comprising a socket body, a fixing structure disposed on the socket body, a conducting wire connected to the socket body on one end thereof, and a plug connected to the other end of the conducting wire.

The present invention has the following advantages: when using the retractable extension socket of the present invention, the outlet can not only be used in extension socket mode, but can also be used as a single plug by winding the conducting wire around the socket body and attaching the plug into the fixing structure. Thus, the usage modes of the outlet are diversified.

Moreover, when the outlet of the present invention is in unused state, the conducting wire can be wound around the socket body so that the plug is disposed in the receiving structure in order that it is easy for the retractable extension socket to be carried around. Thus, it is more portable and convenient.

It is to be understood that both the foregoing general description and the following detailed description are exemplary, and are intended to provide further explanation of the invention as claimed. Other advantages and features of the invention will be apparent from the following description, drawings and claims.

DETAILED DESCRIPTION OF THE PREFERRED EMBODIMENTS

Figure 1:
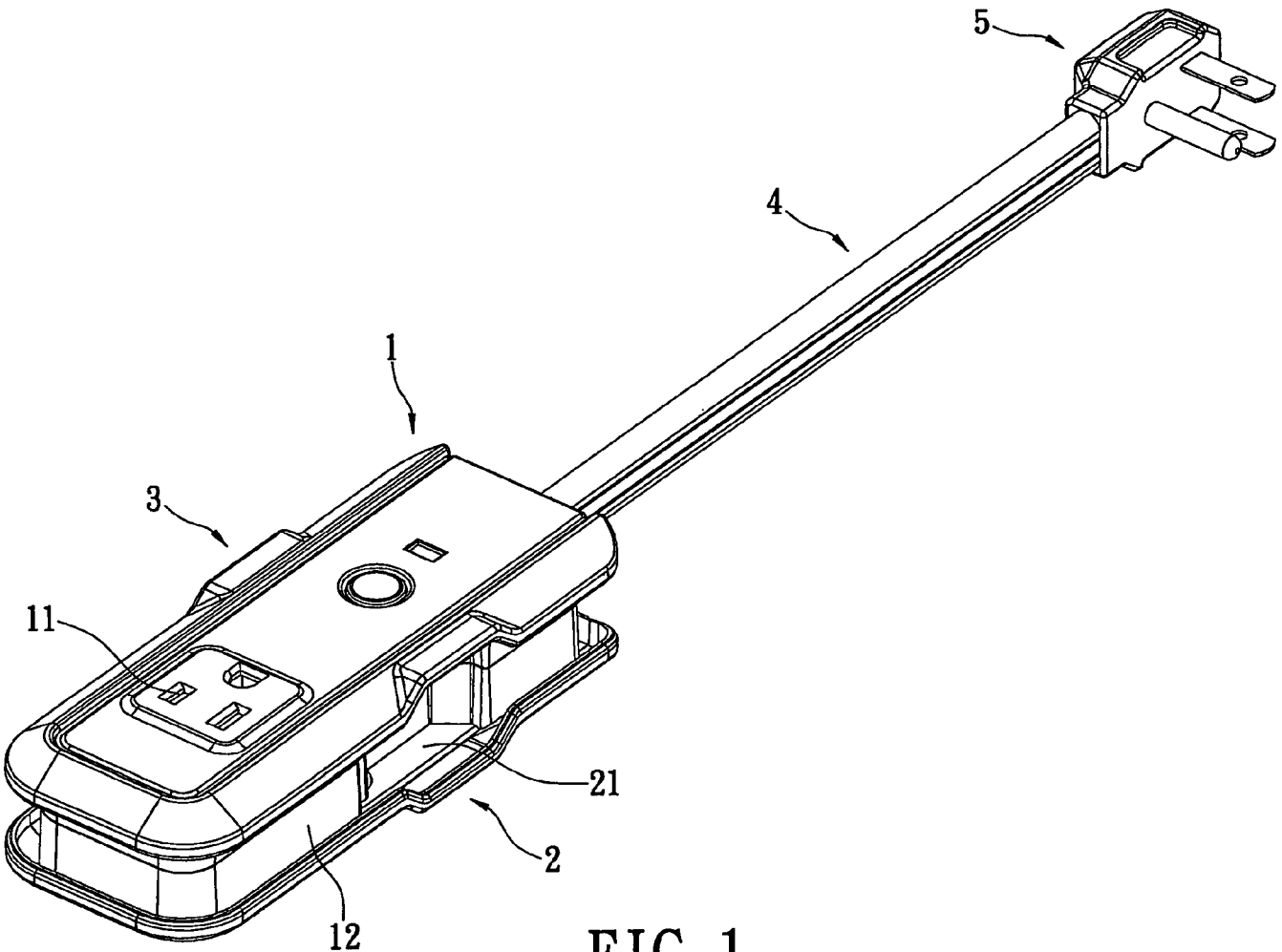
FIG. 1 is a three-dimensional view of the first embodiment of the retractable extension socket of the present invention.
Figure 2:
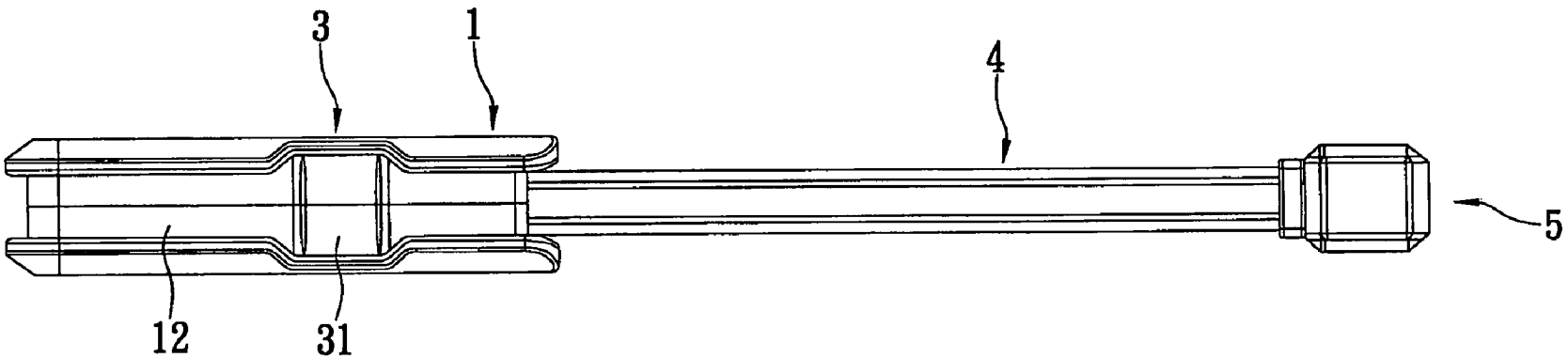
FIG. 2 is a schematic view of the first embodiment of the retractable extension socket of the present invention.

Please refer to FIGS. 1 to 4. The present invention provides a retractable extension socket, comprising a socket body 1, a fixing structure 2, a receiving structure 3, a conducting wire 4, and a plug 5. Wherein, the socket body 1 has a plurality of sockets 11. The specifications of the sockets 11 are not confined and can be diversified appropriately according to the needs of a particular situation. The sockets 11 should be disposed on at least one side of the socket body 1. In this particular example, the socket 11 is disposed on the topside of the socket body 1. In addition, the sockets 11 can also be disposed on both the top and bottom sides of the socket body 1.

The inside of the socket body 1 includes electric conducting plate sheets (not shown) that correspond to the sockets 11. Because the electric conducting plate sheet is of a prior technology and is not included in this patent claim, no detailed description is included herein. The socket body 1 includes a cable slot 12. In this particular example, the cable slot 12 is concavely disposed in the outer rim of the socket body 1, making the conducting wire 4 disposable in the cable slot 12.

The fixing structure 2 is disposed on the socket body 1. In this particular example, the fixing structure 2 is formed as a concave slot 21. The concave slot 21 is disposed concavely at one side of the socket body 1. The concave slot 21 corresponds to the shape of the plug 5. Therefore, the plug 5 can be attached firmly in the concave slot 21.

The receiving structure 3 is disposed on the socket body 1. In this particular example, the receiving structure 3 is formed as a concave slot 31. The concave slot 31 is concavely disposed oppositely to the fixing structure 2 on the side of the socket body 1. The plug 5 can be placed in the concave slot 31 in order that it can be carried around easily.

One end of the conducting wire 4 is connected to the socket body 1. The conducting wire 4 is also electrically connected to the electric conducting plate sheets inside the socket body 1. When the plug of an electronic device is plugged into the socket 11 of the socket body 1, it connects to the conducting wire 4 via the electric conducting plate sheets. The other end of the conducting wire 4 penetrates through the socket body 1. The plug 5 is connected to the other end of the conducting wire 4. The specifications of the plug 5 are not limited and can be changed according to the needs of a particular situation. The plug 5 can be plugged into a household socket, transmitting power to the socket body 1 via the plug 5 and the conducting wire 4. Therefore, electronic devices plugged into the socket body 1 can obtain power. According to the above-mentioned description, the present invention of the retractable extension socket is formed.

As FIG. 1 shows, the present invention can be used as an extension socket. That is, the conducting wire 4 is not wound around the cable slot 12 of the socket body 1. The conducting wire 4 is pulled out, allowing the outlet to be used as a normal extension socket. The plug 5 can be plugged into a household socket. Therefore, electronic devices plugged into the socket body 1 can obtain power.

Figure 3:
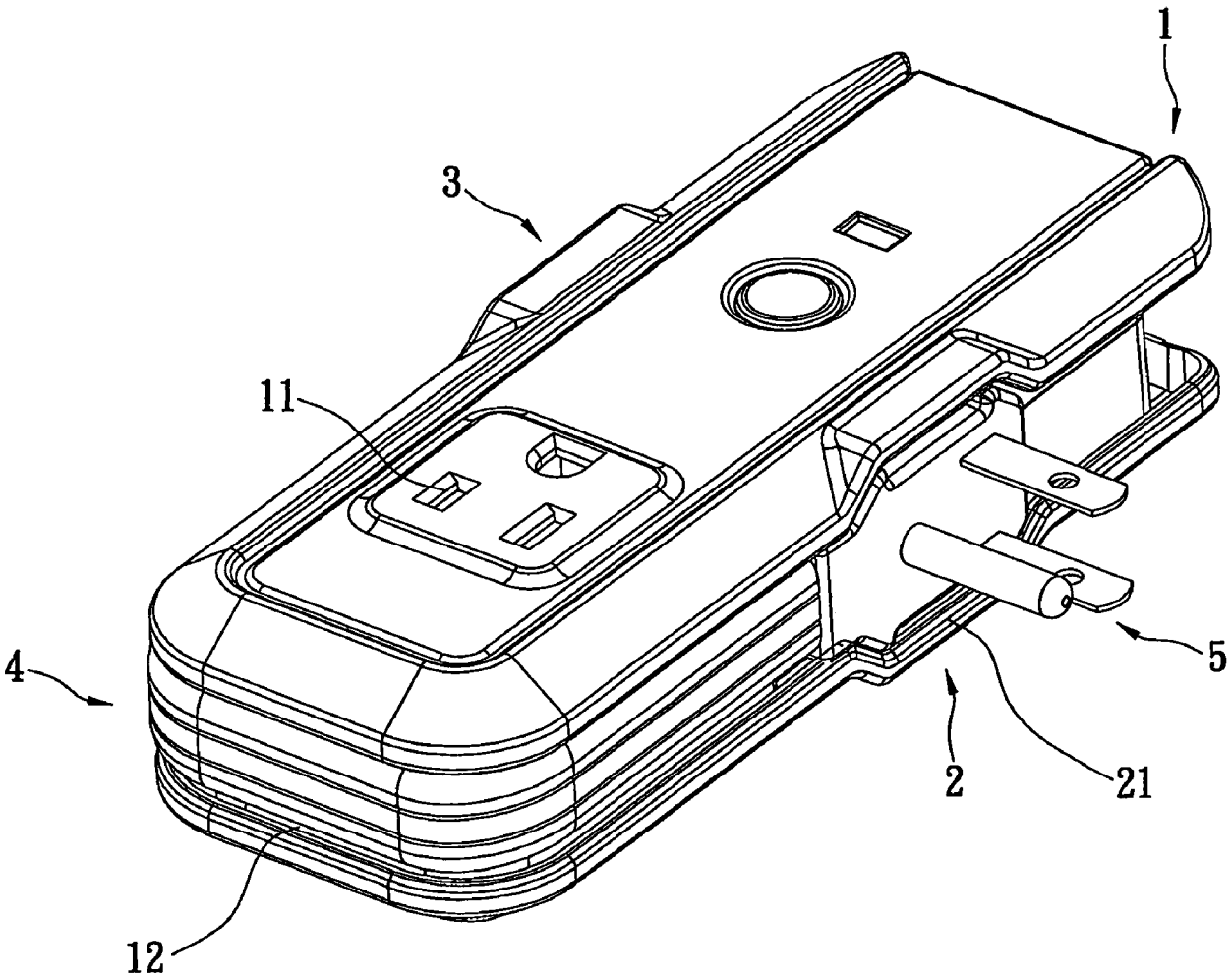
FIG. 3 is a three-dimensional view of the first embodiment of the retractable extension socket of the present invention in another mode.

As FIG. 3 shows, the present invention can also be used as a single plug. That is, the conducting wire 4 is wound around and collected into the cable slot 12. The plug 5 can be attached firmly into the fixing structure 2 (the concave slot 21). The plug 5 can be plugged into a household socket as a single plug so that electronic devices plugged into the socket body 1 can obtain power.

Figure 4:
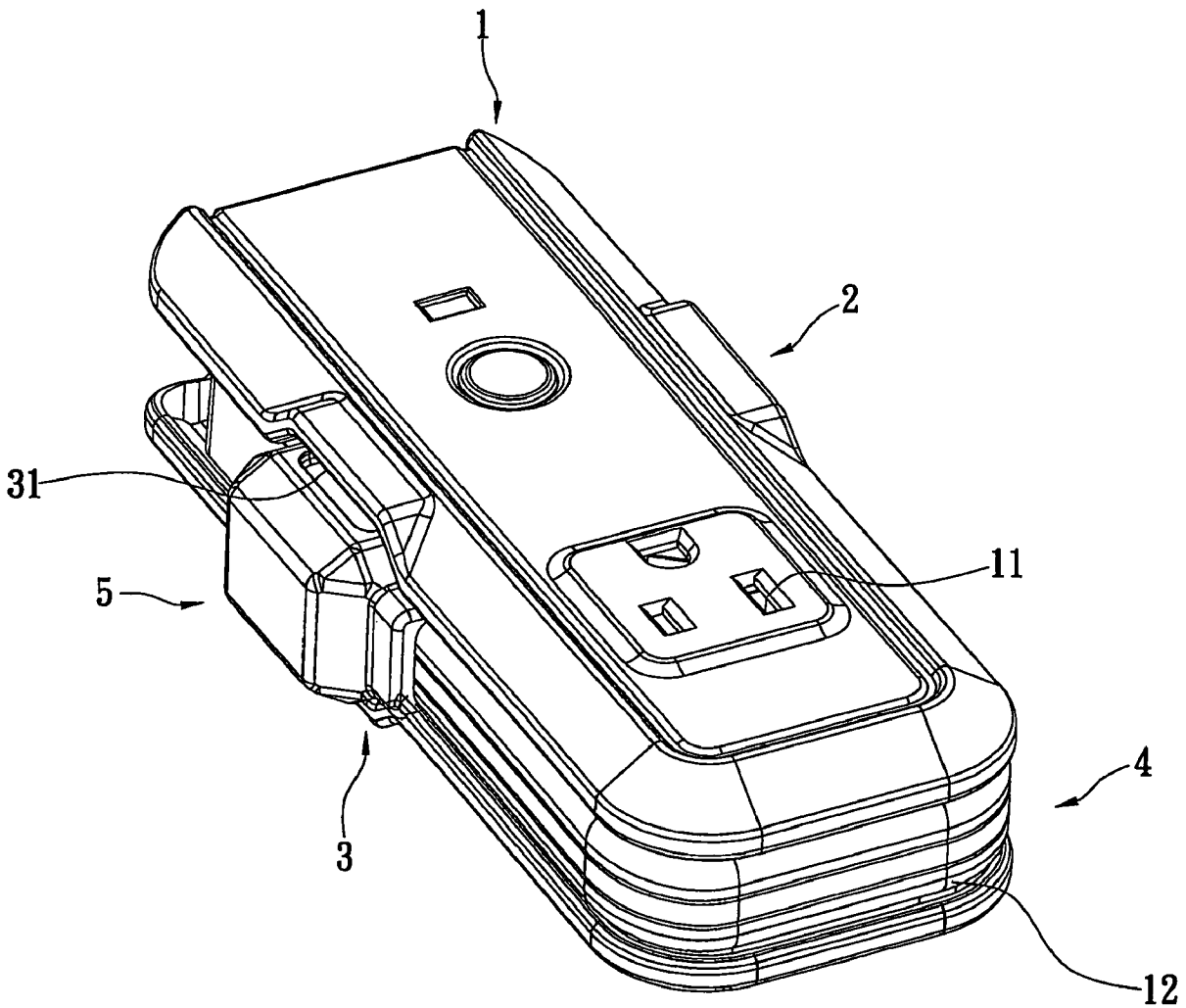
FIG. 4 is a three-dimensional view of the first embodiment of the retractable extension socket of the present invention in yet another mode.

As FIG. 4 shows, when the present invention is not in use the conducting wire 4 can be retracted in order that the present invention can be carried around easily. That is the conducting wire 4 is wound around and collected into the cable slot 12. Next, the plug 5 can be collected into the receiving structure 3 (concave slot 31). Thus, it is more convenient to carry around.

Figure 5:
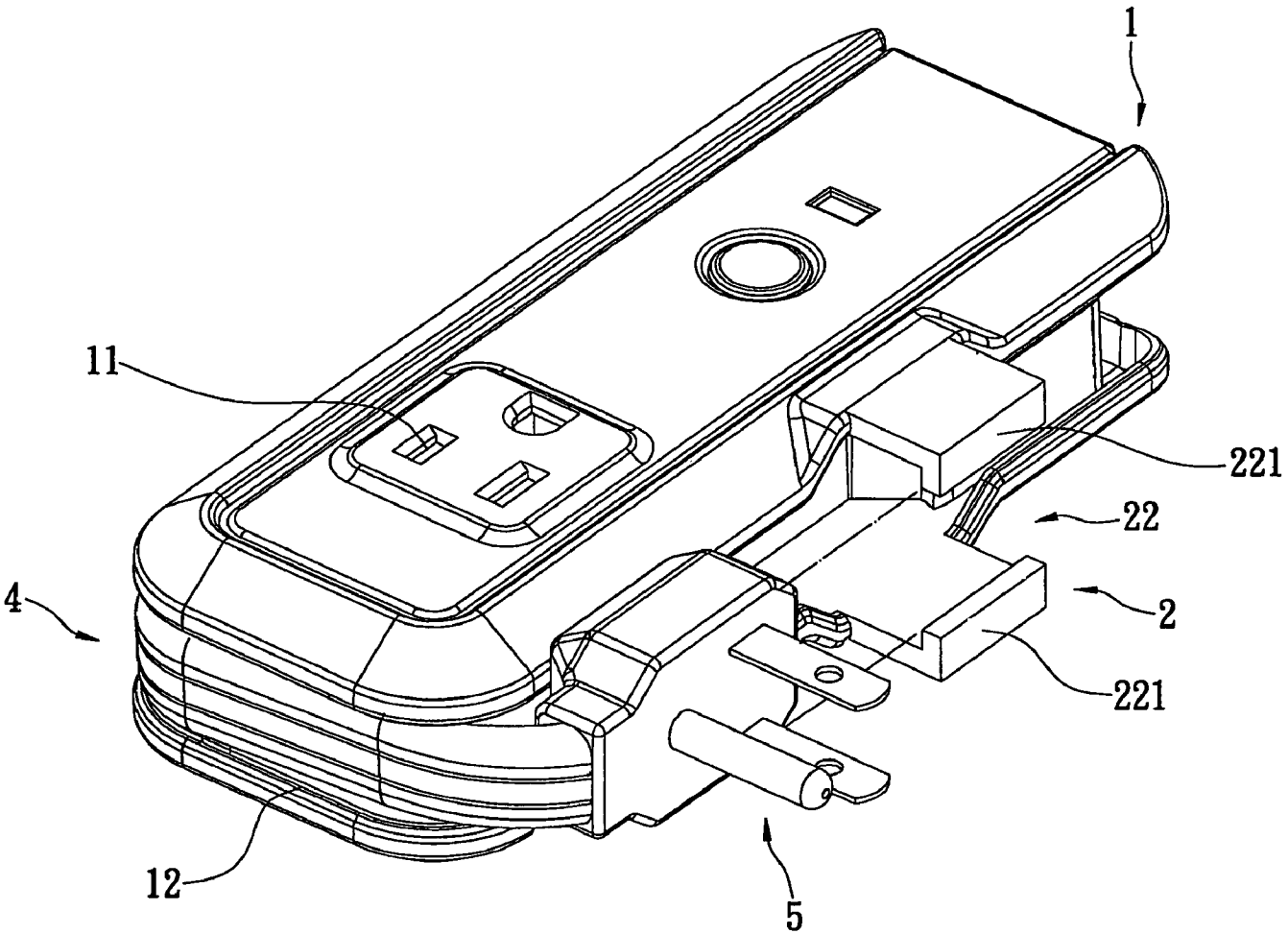
FIG. 5 is a three-dimensional view of the second embodiment of the retractable extension socket of the present invention.

Furthermore, as FIG. 5 shows, in this particular example, the fixing structure 2 is formed as a track 22. The track 22 is composed of two corresponding sliding rails 221. The two sliding rails 221 protrude outwardly from a side of the socket body 1. The plug 5 can be attached firmly between the two sliding rails 221.

Figure 6:
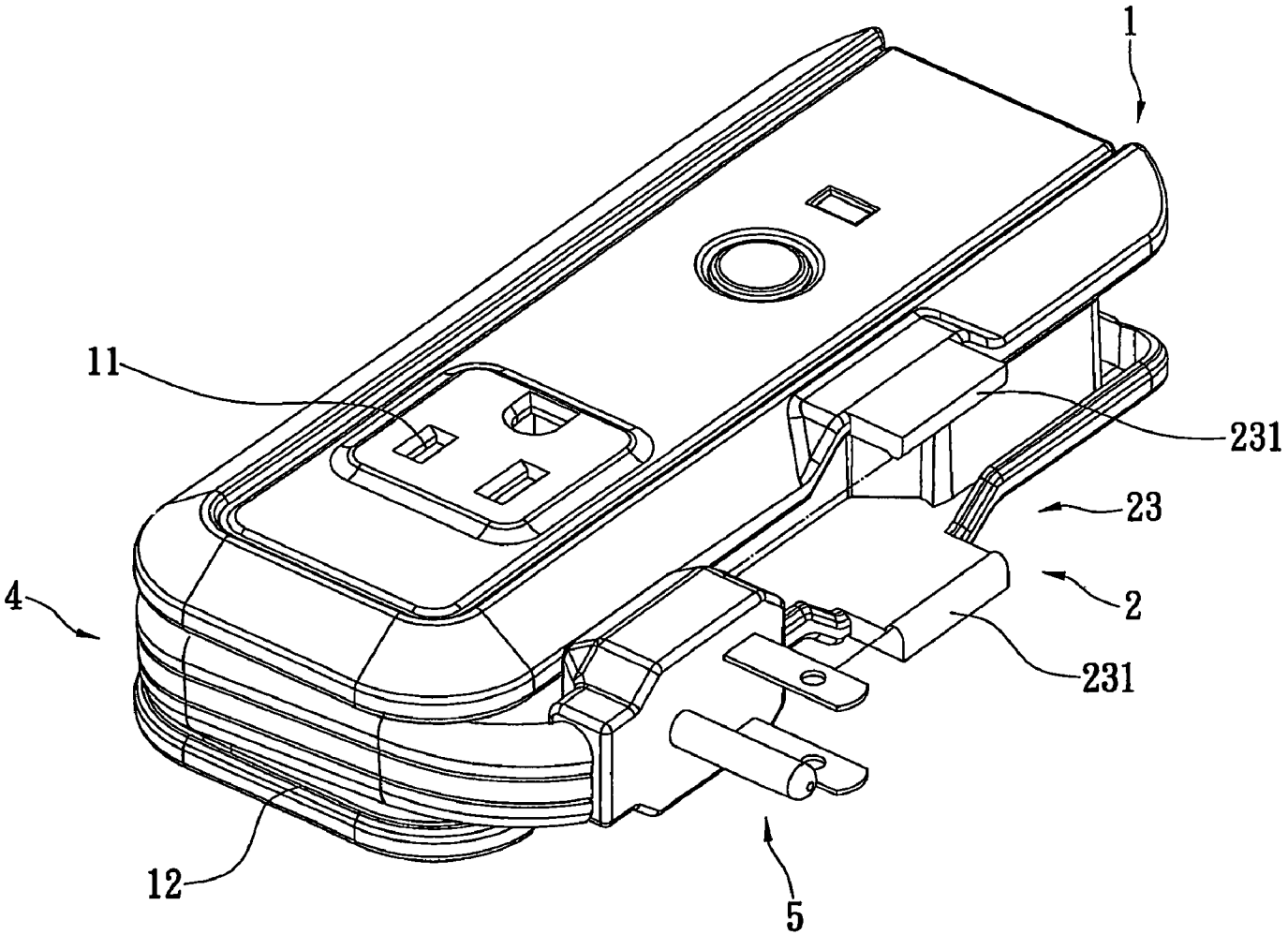
FIG. 6 is a three-dimensional view of the third embodiment of the retractable extension socket of the present invention.

Furthermore, as FIG. 6 shows, the fixing structure 2 is formed as a wedge set 23. The wedge set 23 is composed of two corresponding wedges 231. The two wedges 231 protrude outwardly from a side of the socket body 1. The plug 5 can be attached firmly between the two wedges 231. The wedge set 23 can also be formed with the single wedge 231, and attach the plug 5 firmly using the single wedge 231.

Figure 7:
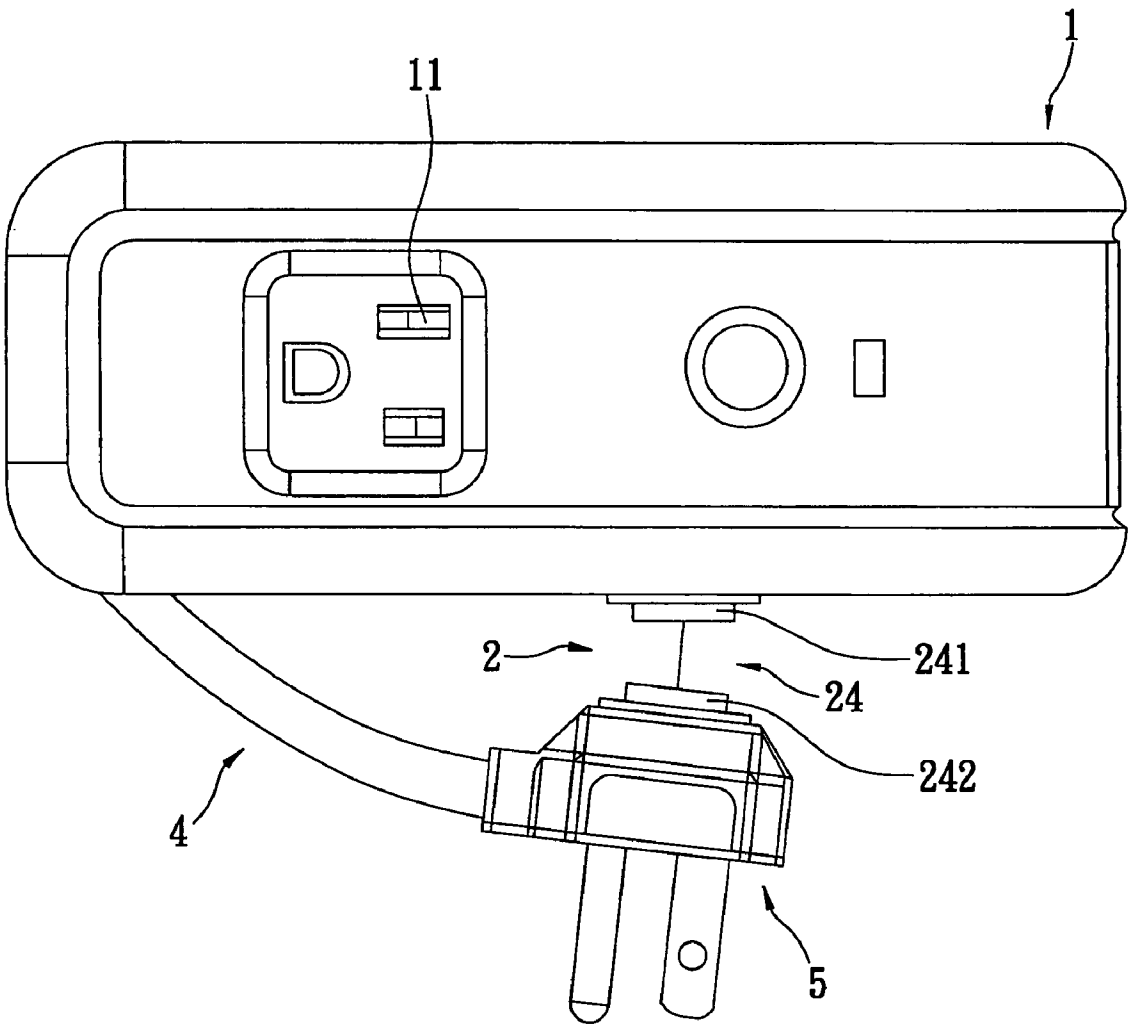
FIG. 7 is a perspective view of the forth embodiment of the retractable extension socket of the present invention.

Furthermore, as FIG. 7 shows, in this particular example, the fixing structure 2 is formed as a fastener set 24. The fastener set 24 has a first fastener 241 and a second fastener 242. The first fastener 241 and the second fastener 242 are fixed separately on the socket body 1 and on the plug 5. The first fastener 241 and the second fastener 242 can be pressed together allowing the plug 5 to attach to the socket body 1.

Figure 8:
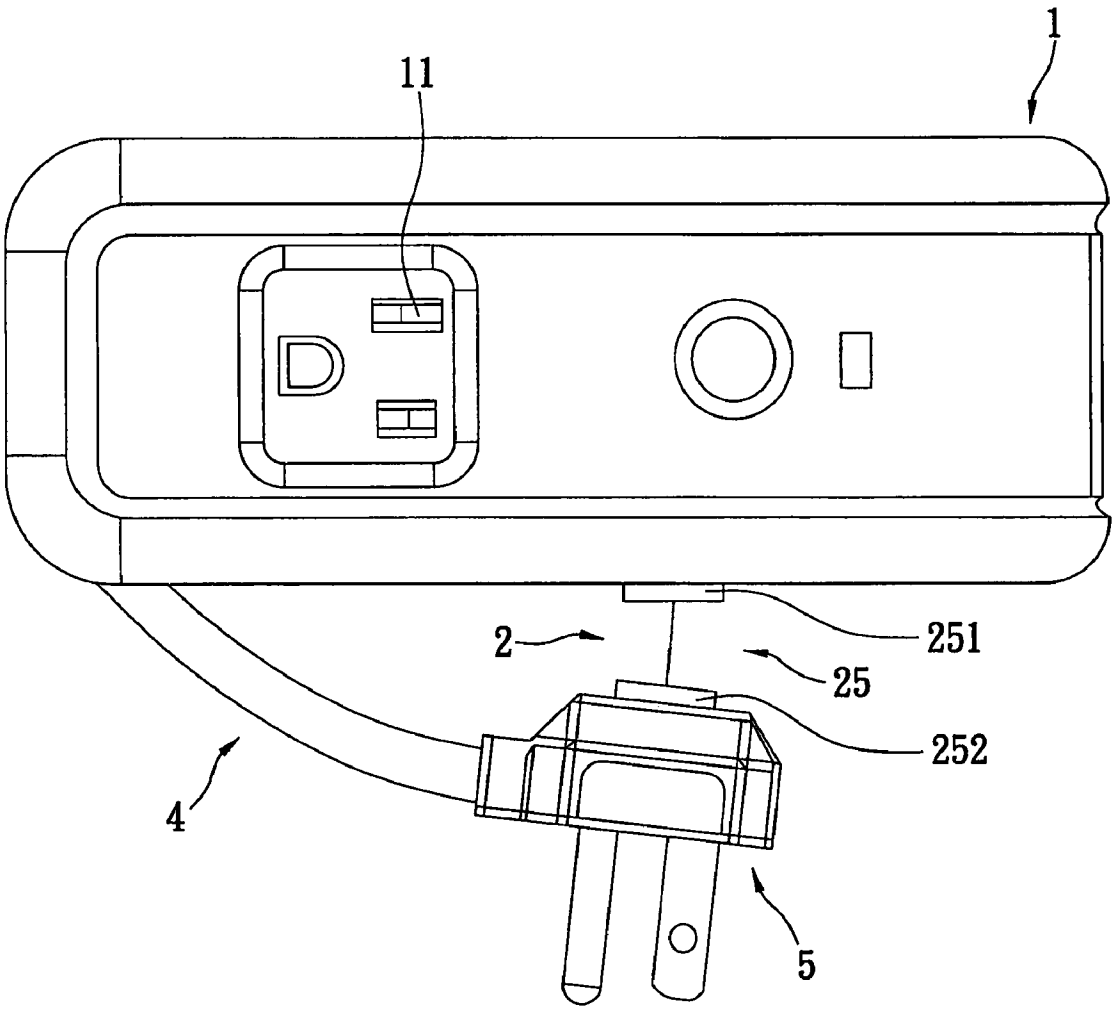
FIG. 8 is a perspective view of the fifth embodiment of the retractable extension socket of the present invention.

Furthermore, as FIG. 8 shows, in this particular example, the fixing structure 2 is formed with a magnet set 25. The magnet set 25 is composed of a first magnet 251 and a second magnet 252. The first magnet 251 and the second magnet 252 can be formed as corresponding magnets or magnet and magnetic metal. The first magnet 251 and the second magnet 252 are fixed separately on the socket body 1 and on the plug 5. The first magnet 251 and the second magnet 252 can be connected firmly to each other through magnetic characteristics, for attaching the plug 5 on the socket body 1.

When using the retractable extension socket of the present invention, the device can not only be used as an extension socket, but also as a single plug by winding the conducting wire 4 to the socket body 1 and attaching the plug 5 into the fixing structure 12. Thus the present invention offers a diverse number of methods of use.

Moreover, when using the outlet of the present invention, the conducting wire 4 can be wound around the socket body 1 and the plug 5 can be disposed into the receiving structure 12 in order that the retractable extension socket can be carried more conveniently.

Furthermore, the conducting wire 4 can be wound around the cable slot 12 of the socket body 1. Then, the plug 5 can be attached firmly in the fixing structure 2 or collected in the receiving structure 3. Therefore, the socket body 1, the conducting wire 4, and the plug 5 are properly attached. With this method of managing the wires, things appear uncluttered.

Although the present invention has been described with reference to the preferred best molds thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A retractable extension socket, comprising;

a socket body;

a plug-fixing structure disposed on the socket body;

a plug-receiving structure disposed on the socket body;

a conducting wire, one end of which is connected to the socket body; and a plug having electrical prongs connected to the other end of the conducting wire, wherein said plug is selectively reconfigurable to:

(1) be able to be captured within said plug-fixing structure in a manner where said plug electrical prongs are fixedly positioned unobstructed and extend external to said socket body for connection to an external socket on a wall as a wall-hanging socket, and;

(2) be insertable within said plug-receiving structure formed on said socket body for fixedly positioning said plug to said socket body in a manner where said plug electrical prongs are enclosed within said plug-receiving structure.

2. The retractable extension socket as claimed in claim 1, wherein the socket body has a cable slot.

3. The retractable extension socket as claimed in claim 2, wherein the cable slot is disposed around a rim of the socket body.

4. The retractable extension socket as claimed in claim 2, wherein the conducting wire is wound on and collected in the cable slot, the plug is attaching in the fixing structure, and is used as a single plug.

5. The retractable extension socket as claimed in claim 2, wherein the conducting wire is wound on and collected in the cable slot, the plug is collected in the receiving structure, allowing the plug to be carried around conveniently.

6. The retractable extension socket as claimed in claim 1, wherein the socket body has a plurality of connection plug sockets.

7. The retractable extension socket as claimed in claim 6, wherein the plurality of connection plug sockets is disposed on a top or on the top and bottom of the socket body.

8. The retractable extension socket as claimed in claim 1, wherein the fixing structure is formed as a concave slot for attaching the plug on the socket body.

9. The retractable extension socket as claimed in claim 1, wherein the fixing structure is formed as a track having two corresponding sliding rails for attaching the plug on the socket body.

10. The retractable extension socket as claimed in claim 1, wherein the fixing structure is formed as a wedge set having a single wedge or two corresponding wedges for attaching the plug on the socket body.

11. The retractable extension socket as claimed in claim 1, wherein the fixing structure is formed as a fastener set having two corresponding first and second fasteners, the first and second fasteners are disposed separately on the socket body and on the plug, and the first and second fasteners are pressed together for attaching the plug on the socket body.

12. The retractable extension socket as claimed in claim 1, wherein the fixing structure is formed as a magnet set having a first magnet and a second magnet, the first and second magnets are disposed separately on the socket body and on the plug, and the first and second magnets connect to each other firmly through magnetic force for attaching the plug on the socket body.

13. The retractable extension socket as claimed in claim 1, wherein the receiving structure is formed as a concave slot.

* * * * *